US012569020B2

(12) United States Patent
Hoetger

(10) Patent No.: US 12,569,020 B2
(45) Date of Patent: Mar. 10, 2026

(54) HAT

(71) Applicant: Ralph Hoetger, Cotter, AR (US)

(72) Inventor: Ralph Hoetger, Cotter, AR (US)

( * ) Notice: Subject to any disclaimer, the term of this patent is extended or adjusted under 35 U.S.C. 154(b) by 0 days.

(21) Appl. No.: 19/012,238

(22) Filed: Jan. 7, 2025

(65) Prior Publication Data

US 2025/0234950 A1 Jul. 24, 2025

Related U.S. Application Data

(60) Provisional application No. 63/622,954, filed on Jan. 19, 2024.

(51) Int. Cl.
*A42B 1/245* (2021.01)
*A42B 1/22* (2006.01)
*A42C 5/02* (2006.01)

(52) U.S. Cl.
CPC ..... *A42B 1/245* (2013.01); *A42B 1/22* (2013.01); *A42C 5/02* (2013.01)

(58) Field of Classification Search
CPC ..... A42B 1/002; A42B 1/0186; A42B 1/0188; A42B 1/22; A42B 1/24; A42B 1/245; A42C 5/00; A42C 5/02; A42C 5/04
See application file for complete search history.

(56) References Cited

U.S. PATENT DOCUMENTS 1,518,941 A * 12/1924 Solomon ..... A42C 5/04 D2/894
1,571,827 A * 2/1926 Wharton ..... A42C 5/02 2/181.6
1,973,594 A * 9/1934 Wolf ..... A42C 5/04 2/183
2,451,140 A * 10/1948 Wittcoff ..... A42B 3/14 2/181.8
2,844,820 A * 7/1958 Austin ..... A42B 3/166 2/6.1
3,245,088 A * 4/1966 Robison ..... A42B 1/02 2/171.02
4,023,212 A * 5/1977 Huffman ..... A42B 1/205 2/171.1
4,633,530 A * 1/1987 Satterfield ..... A42B 3/16 2/209
5,553,326 A * 9/1996 Moore ..... A42C 5/02 2/209.13
5,664,261 A * 9/1997 Lacy ..... A42B 7/00 2/172
5,724,676 A * 3/1998 Amendolia ..... A42B 1/22 2/418

(Continued)

*Primary Examiner* — Heather Mangine

(74) *Attorney, Agent, or Firm* — Clement Cheng

(57) ABSTRACT

A hat comprising a canopy. The canopy has a front sweatband and a rear sweatband with a right sweatband gap on a right side of the canopy and a left sweatband gap on a left side of the canopy. The front sweatband has a front sweatband right edge and a front sweatband left edge. The rear sweatband has a rear sweatband right edge and a rear sweatband left edge. The front sweatband right edge and the rear sweatband right edge define edges of the right sweatband gap. The front sweatband left edge and the rear sweatband left edge define edges of the left sweatband gap. Right and left ear panels are mounted to the right and left sides of the canopy at the right and left sweatband gaps.

2 Claims, 6 Drawing Sheets

(56) References Cited

U.S. PATENT DOCUMENTS 5,881,160 A * 3/1999 Sheppard ..... A42B 1/245 381/376
5,920,910 A * 7/1999 Calvo ..... A42C 5/02 2/DIG. 11
5,956,759 A * 9/1999 Benedict ..... A42C 5/04 2/171.2
5,978,968 A * 11/1999 Lee ..... A42B 1/002 2/182.2
5,978,969 A * 11/1999 Vinding Diers ..... A42C 5/02 2/DIG. 11
6,012,173 A * 1/2000 Lee ..... A42B 1/002 2/182.2
6,016,572 A * 1/2000 Park ..... A42C 5/02 2/175.1
6,052,831 A * 4/2000 Park ..... A42C 5/02 2/195.3
6,079,052 A * 6/2000 Veridiano ..... A42B 1/0182 2/172
6,163,888 A * 12/2000 Park ..... A42B 1/22 2/195.3
6,240,566 B1 * 6/2001 Scantlin ..... A42B 1/225 2/209.13
6,336,224 B1 * 1/2002 Wang ..... A42C 5/02 2/195.3
6,339,844 B1 * 1/2002 Merkley ..... A42C 5/02 2/181.2
6,347,410 B1 * 2/2002 Lee ..... A42C 5/02 2/181
6,920,644 B1 * 7/2005 Higgs ..... A42B 1/22 2/195.3
D614,380 S * 4/2010 Lam ..... D2/882
7,814,573 B1 * 10/2010 Greenberg ..... A42B 1/22 2/181
D661,028 S * 5/2012 Hollingsworth ..... D29/122
D694,493 S * 12/2013 Presha ..... D2/882
11,363,848 B1 * 6/2022 Goodman ..... A42B 1/248
2003/0037365 A1 * 2/2003 Wilson ..... A42B 1/22 2/181
2003/0074721 A1 * 4/2003 Ma ..... A42B 3/30 2/209.13
2003/0131395 A1 * 7/2003 Putnam ..... A41D 20/00 2/181
2003/0213049 A1 * 11/2003 Hahn ..... A42C 5/02 2/181.4
2004/0003450 A1 * 1/2004 Wang ..... A42B 1/22 2/181
2005/0160518 A1 * 7/2005 Cho ..... A42B 1/22 2/181
2005/0160519 A1 * 7/2005 Cho ..... A42B 1/22 2/181
2006/0041992 A1 * 3/2006 Liao ..... A42B 1/22 2/195.3
2006/0168708 A1 * 8/2006 Moshier ..... A42B 1/0182 2/175.6
2007/0056078 A1 * 3/2007 Tseng ..... A42B 1/22 2/171
2008/0034473 A1 * 2/2008 Wong ..... A42C 5/02 2/181
2008/0163406 A1 * 7/2008 Solari ..... A42B 1/22 2/195.3
2009/0208040 A1 * 8/2009 Planansky ..... H04R 5/02 381/301
2009/0257615 A1 * 10/2009 Bayer, Jr. ..... A42B 1/0188 381/376
2010/0107317 A1 * 5/2010 Wang ..... A42B 1/08 2/411
2011/0047673 A1 * 3/2011 Mao ..... A42B 1/22 2/175.1
2013/0133671 A1 * 5/2013 Fairclough ..... A61F 11/14 2/209
2013/0219593 A1 * 8/2013 Snyder ..... A42B 1/08 2/411
2014/0047617 A1 * 2/2014 Abers ..... A42B 1/245 2/209.13
2014/0230129 A1 * 8/2014 Viviani ..... A42B 1/24 2/209.13
2016/0219962 A1 * 8/2016 Abers ..... A42B 1/245
2016/0331057 A1 * 11/2016 Hawes ..... A42B 1/245
2017/0188644 A1 * 7/2017 Foresta ..... A42C 5/02
2018/0255860 A1 * 9/2018 Heaton ..... A42B 1/245
2019/0297983 A1 * 10/2019 Kalhori ..... A42B 3/16
2020/0000172 A1 * 1/2020 Wong ..... A42C 5/04
2020/0054089 A1 * 2/2020 Gong ..... A42B 1/006
2022/0031001 A1 * 2/2022 Binns ..... A42B 1/019
2022/0095730 A1 * 3/2022 Rutigliano ..... A42B 1/0189
2023/0035442 A1 * 2/2023 Keller ..... A42C 1/08
2023/0143153 A1 * 5/2023 Buck ..... G10K 11/22 181/135
2024/0156197 A1 * 5/2024 Yu ..... A42B 1/004
2025/0031794 A1 * 1/2025 Mellett, III ..... A41G 5/0093
2025/0049162 A1 * 2/2025 Spruill ..... A42B 1/0188
2025/0073083 A1 * 3/2025 Klock ..... A61F 11/14
2025/0185742 A1 * 6/2025 Nelson ..... A42B 1/24
2025/0234950 A1 * 7/2025 Hoetger ..... A42B 1/0182

* cited by examiner

HAT

FIELD OF THE INVENTION

The present invention is in the field of hats.

DISCUSSION OF RELATED ART

A variety of different hat configurations have been discussed in United States patents. For example, in U.S. Pat. No. 6,347,410 entitled, "Self-Sizing Baseball Cap" by Razgo Lee, published Feb. 19, 2002, the inventor describes, "The self-sizing baseball cap with a two or more piece, one or more layer sweatband satisfies the long recognized need of providing a baseball cap that fits a range of head sizes comfortable without any wearer adjustable cap sizing devices. This sweatband is flexibly attached to the self-sizing baseball cap so that it can be in either the stowed or deployed position when wearing the cap. When deployed, it creates an expanded self-adjustable attachment area on the wearer's head and provides more shade and warmth to the wearer. The two or more piece, one or more layer sweatband can be made from one or more than one different material with some or all materials biaxially or uniaxially stretchable. Each piece of the sweatband can be a different color or the same color as the other sweatband pieces."

For example, in United States publication number 2013/0219593 entitled, "Hat with Protective Band" by John Henry Snyder, published Aug. 29, 2013, the inventor describes, "A protective band that may be added to a hat, such as a baseball hat, is included. The protective band may include an outer layer and inner layer. The outer layer may include cloth and the inner layer may include foam. The protective band may fit within the hat and may be worn with the hat."

For example, in United States publication number 2005/0160519 entitled "HEADWEAR" by Byoung-Woo Cho, published Jul. 28, 2005, the inventor describes, "Disclosed is a headwear which is mainly made of non-stretchable fiber. The headwear comprises a head receiving portion including a first stretchable fabric made of high twist yarn and a sweat band peripherally attached to the inside of the head receiving portion. Since the head receiving portion is mainly made of high twist yarn, the headwear has a fixed peripheral size but is adjustable within a predetermined range corresponding to small changes of head size. Also, the headwear can fit the head size to provide a comfortable sense of wearing."

For example, in U.S. Pat. No. 6,920,644 entitled, "Cap with Stretchable Band," by Michael Higgs, the inventor describes, "A peak cap (1) having a crown (2) with an inner elastically stretchable band (13) positioned to extend at least partway along a lower encircling edge (10) and a liner of stretchable fabric (12) secured to be on an inner side of the elastic material of the band (13). Also described is a band with the liner in the form of a sleeve (23) through which an elastic member (24) extends and where the liner but no the elastic material is secured to the lower edge of the crown (2)."

SUMMARY OF THE INVENTION

A hat has a canopy with a front sweatband and a rear sweatband. The canopy forms a crown. A right sweatband gap is on a right side of the canopy and a left sweatband gap is on a left side of the canopy. A right ear panel is mounted to a right side of the canopy at the right sweatband gap and a left receiving panel is mounted to a left side of the canopy at the left sweatband gap.

A hat comprising a canopy. The canopy has a front sweatband and a rear sweatband with a right sweatband gap on a right side of the canopy and a left sweatband gap on a left side of the canopy. The front sweatband has a front sweatband right edge and a front sweatband left edge. The rear sweatband has a rear sweatband right edge and a rear sweatband left edge. The front sweatband right edge and the rear sweatband right edge define edges of the right sweatband gap. The front sweatband left edge and the rear sweatband left edge define edges of the left sweatband gap. A right ear panel is mounted to a right side of the canopy at the right sweatband gap.

The right ear panel is connected to the front sweatband right edge and the rear sweatband right edge. A left ear panel is mounted to a left side of the canopy at the left sweatband gap, wherein the left ear panel is connected to the front sweatband left edge and the rear sweatband left edge. A right headphone strap extends from the rear sweatband right edge to the front sweatband right edge. A left headphone strap extends from the rear sweatband left edge to the front sweatband left edge. The right headphone strap is elastic and extends over the right ear panel. The left headphone strap is elastic and extends over the left ear panel.

A right headphone fits between the right headphone strap and the right ear panel. A left headphone fits between the left headphone strap and the left ear panel. The hat optionally has a left ear loop and a right ear loop. The right and left ear loop can be made of spring wire. The left ear loop is mounted in the left sweatband gap and the right ear loop is mounted in the right sweatband gap. The left ear loop has a left ear loop front end and a left ear loop rear end. The right ear loop has a right ear loop front end and a right ear loop rear end. A left ear loop front end pocket receives a left ear loop front end. A left ear loop rear end pocket receives a left ear loop rear end. A right ear loop front end pocket receives a right ear loop front end. A right ear loop rear end pocket receives a right ear loop rear end. Ear loop end pockets include the left ear loop rear end pocket, left ear loop front end pocket, right ear loop front end pocket, right ear loop rear end pocket. The ear loop end pockets are made from stitching a sweatband by stitching a sweatband outside layer to a sweatband inside layer. The hat has a visor that connects to the canopy. The canopy includes a front right canopy panel and a front left canopy panel. The canopy includes a rear right canopy panel and a rear left canopy panel.

The left ear loop can be connected to the right ear loop at both a rear bend and a front bend such that the wire is continuous around a lower periphery of the canopy.

Ear covers include earmuffs, headphones or headsets or the like. Ear covers have an acoustic foam gasket. The key feature of the present invention is the pair of ear panels which improve the acoustic seal between the user, ear panels and the acoustic foam gasket. The ear panels are adjacent to the ear. The ear panels are sheer and thin, preferably about half a millimeter or less such as 0.14 mm. The ear panels are breathable.

The following call outs can be a useful guide in referencing the claim elements of the drawings.

11 Hat
12 Visor
13 Adjustment Strap
14 Canopy
15 Right Ear Panel
16 Left Ear Panel
17 Adjustment Strap Opening
21 Rear Left Canopy Panel
22 Rear Right Canopy Panel
23 Front Left Canopy Panel
24 Front Right Canopy Panel
25 Left Middle Canopy Panel
26 Right Middle Canopy Panel
31 Rear Sweatband
32 Front Sweatband
33 Rear Sweat Band Right Edge
34 Rear Sweat Band Left Edge
35 Front Sweatband Left Edge
36 Front Sweat Band Right Edge
41 Receiving Panel Upper Edge
44 Receiving Panel Lower Edge
45 Receiving Panel Rear Edge
46 Receiving Panel Front Edge
50 Cutout Step
51 First Cutout
52 Second Cutout
53 First Cutout Profile
54 Second Cutout Profile
60 Insert Step
61 First Insert
62 Second Insert
63 First Insert Profile
64 Second Insert Profile
70 Wire Insert Step
71 Wire Insert
72 Right Ear Loop
73 Left Ear Loop
74 Front Bend
75 Rear Bend
76 Right Wire Insert
77 Left Wire Insert
85 Left Headphone
86 Right Headphone
87 Sweatband Gap
88 Right Sweatband Gap
89 Left Sweatband Gap
90 Wire End Retainer
91 Wire End
92 Wire End Receiver
93 Wire End Receiver Pocket
94 Wire End Receiver Pocket Stitch
95 Sweat Band End
96 Sweatband Outsider Layer
97 Sweatband Lower Fold
98 Sweatband Inside Layer
99 Wire End Retainer Area
101 Right Headphone Strap
102 Left Headphone Strap
103 Top Strap
104 Canopy Top

DETAILED DESCRIPTION OF THE PREFERRED EMBODIMENT

Figure 1:
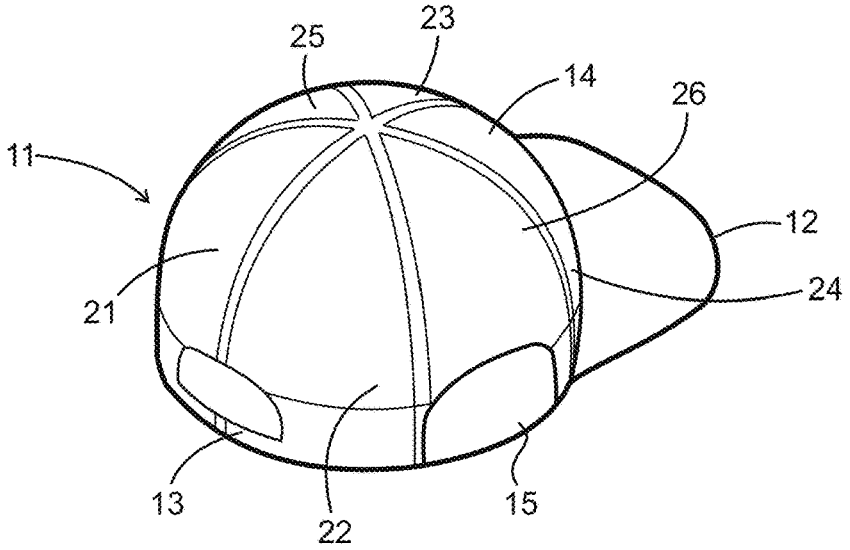
FIG. 1 is a right rear upper perspective view, the left rear perspective view of which is symmetrical thereto.

As seen in FIG. 1, a hat 11 can be formed as baseball cap having a canopy 14. The canopy 14 can have six segments, namely a rear left canopy panel 21, a rear right canopy panel 22, a front left canopy panel 23, a front right canopy panel 24, a left middle canopy panel 25, and a right middle canopy panel 26. The rear right canopy panel 22 and the rear left canopy panel 21 are joined at an adjustment strap 13. The adjustment strap 13 can have a buckle, or can be elastic to provide a gentle retaining bias around the user. The hat 11 can also be formed in eight segments such as in eight panels for an eight panel hat. In an eight panel hat, the right middle canopy panel of the six panel hat would include a right front middle canopy panel and a right rear middle canopy panel as well as a left front middle canopy panel and a left rear middle canopy panel. The right ear panel and the left ear panel would be formed in the right middle canopy panels. The right ear panel and the left ear panel can be formed as straps or have other types of openings such as circular or elongated openings. There may or may not be a button on top. Lack of a button is preferred due to a strap being preferred.

The visor 12 is connected to the front left canopy panel 23 and the front right canopy panel 24. The hat 11 has a pair of receiving panels, namely right ear panel 15 and a left receiving panel on the opposite side of the right ear panel 15. The receiving panels are preferably formed of a single sheet of fabric such as a mesh mounted under the middle canopy panels. The right ear panel 15 is mounted under the right middle canopy panel 26, and the left receiving panel is mounted under the left middle canopy panel 25. The adjustment strap 13 can pull the receiving panels flat against the user's head.

Figure 2:
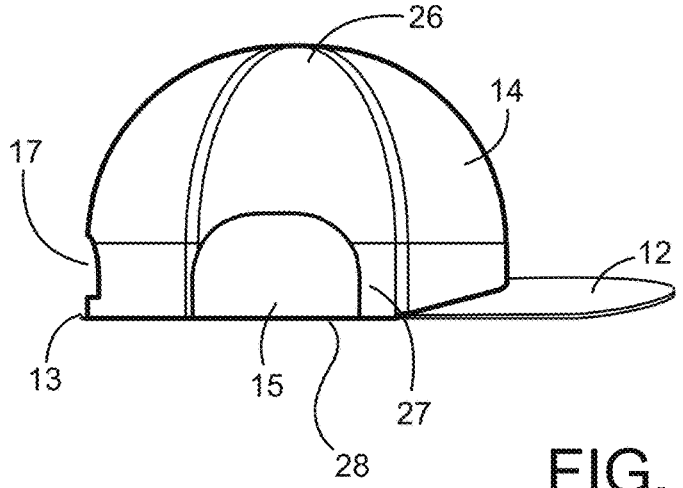
FIG. 2 is a right view, the left view of which is symmetrical thereto.

As seen in FIG. 2, the canopy 14 has a lower edge 28. The receiving panel such as the right ear panel 15 has a receiving panel edge 27 where the receiving panel is connected to the canopy 14. The right ear panel 15 has a lower edge extending horizontally that is flush with and matches a lower edge of the hat. The right ear panel 15 as an upper edge that extends horizontally and can have an arc shape portion which can be partially elastic. The right ear panel and the left ear panel are preferably made of a partially elastic mesh material such as a mesh fabric.

Figure 3:
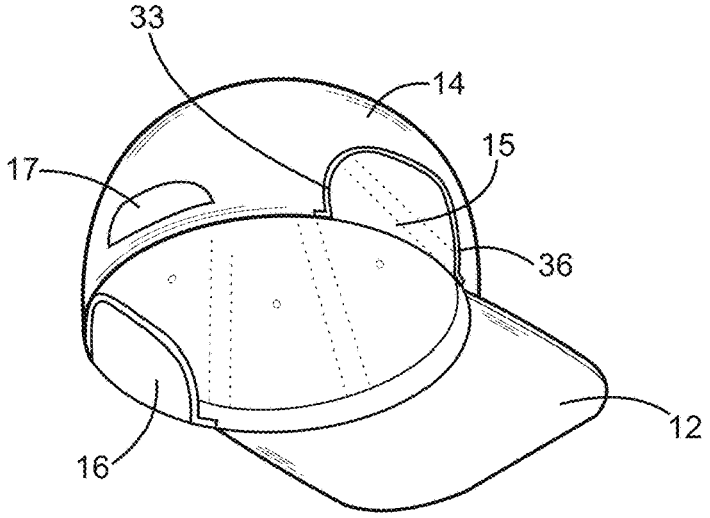
FIG. 3 is a right rear lower perspective view, the left rear lower perspective view of which is symmetrical thereto.

As seen in FIG. 3, the visor 12 is connected to a lower edge of the canopy 14. A right ear panel 15 and a left receiving panel 16 are mounted to the canopy 14. The adjustment strap opening 17 is opposite the visor 12. The front sweatband has a front sweatband right edge 36. The right ear panel 15 is preferably a mesh or single ply fabric fitting snugly against the head. The right ear panel and the left ear panel do not have a sweatband and have a thickness that is consistent throughout the right ear panel and the left ear panel.

Figure 4:
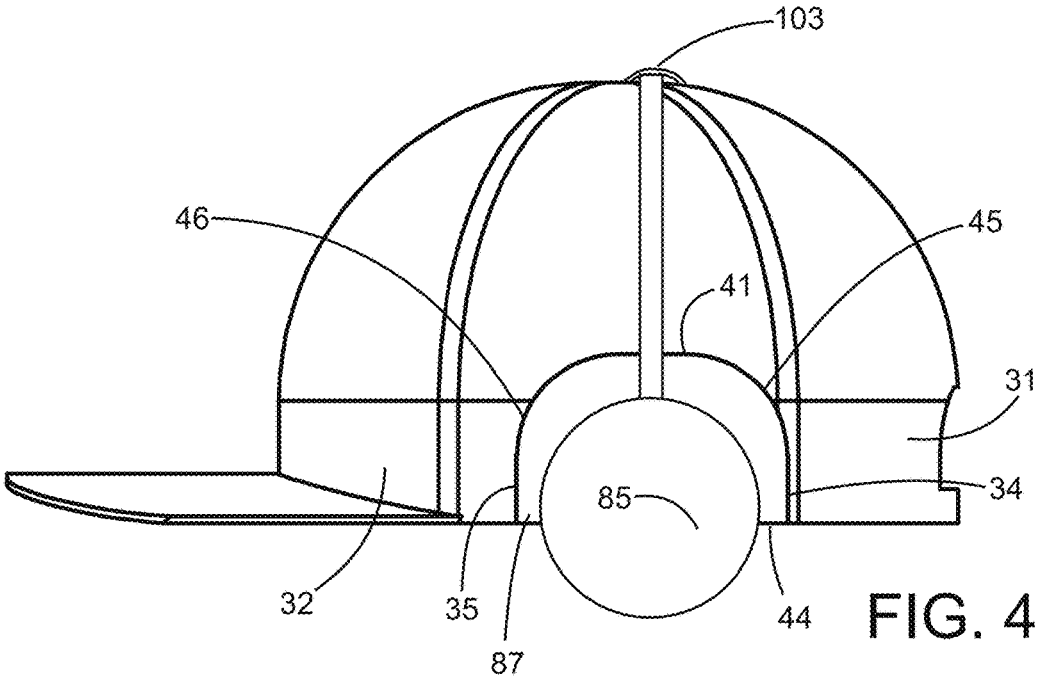
FIG. 4 is a left view of the present invention.

As seen in FIG. 4, the front sweatband 32 is opposite the rear sweatband 31. The sweatband gap 87 is formed between the front sweatband left edge 35 and the four rear sweatband left edge 34. The front sweatband left edge 34 is connected to the receiving panel front edge 46 and the receiving panel rear edge 45 is connected to the rear sweatband left edge 34. The front sweatband left edge connects the receiving panel front edge 46 to the canopy 14 such as by stitching. Similarly, the rear sweatband left edge 34 connects the rear sweatband 31 to the receiving panel rear edge 45 such as by stitching. The right ear panel and the left ear panel could be unconnected to the receiving panel upper edge 41 to allow an additional ventilation opening.

Figure 5:
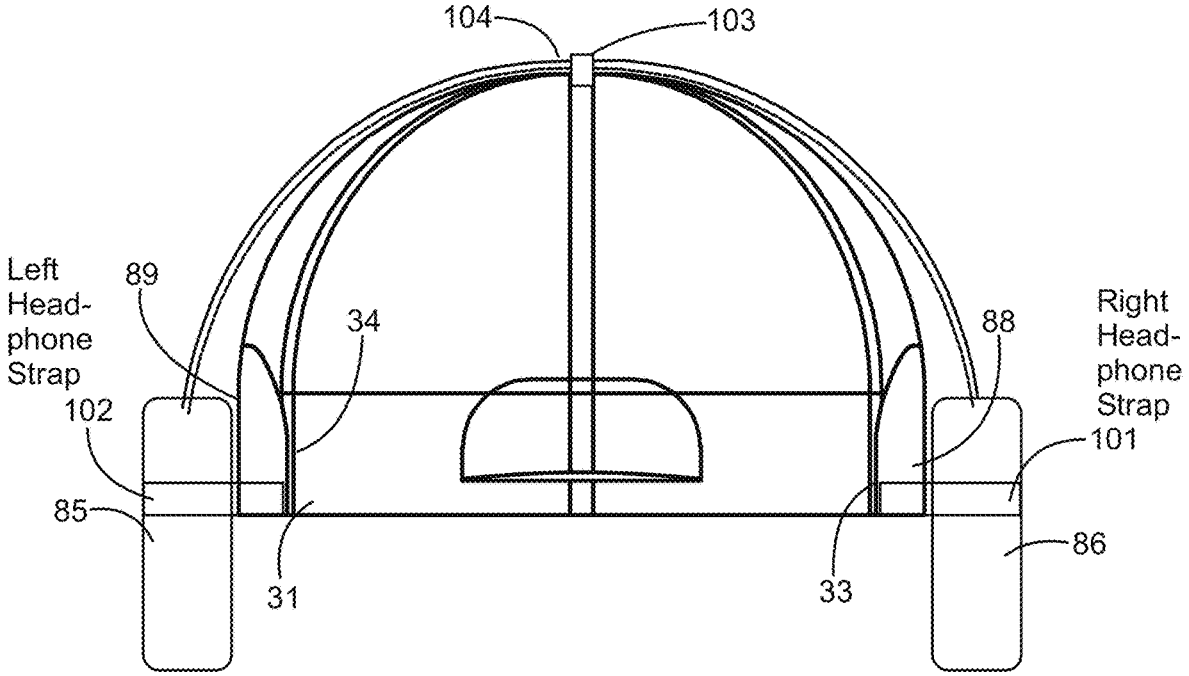
FIG. 5 is a rear view of the present invention.

As seen in FIG. 5, the right headphone 86 presses against the right ear panel at the right sweatband gap 88. The left headphone 85 presses against the left receiving panel at the left sweatband gap 89. The right sweatband gap 88 continues to a rear sweatband right edge 33. The left sweatband gap 89 continues to a rear sweatband left edge 34. The rear sweatband 31 has a rear sweatband left edge 34 and a rear sweatband right edge 33. The right headphone 86 and the left headphone 85 fit over the left sweatband gap 89 and the right sweatband gap 88. The right headphone 86 does not touch the rear sweatband right edge 33 and the left headphone 85 does not touch the rear sweatband left edge 34. The headphones do not touch the canopy 14, except at the sweatband gaps. The headphones extend downwardly lower than the sweatband gaps, and partially at a level of the sweatband gaps. The headphones can extend to a height above the sweatband gaps.

A right headphone strap 101 can strap the right headphone 86 to the hat and a left headphone strap 102 and strap a left headphone 85 to the hat. The right headphone strap 101 preferably extends from the rear sweatband right edge 33 at the right sweatband gap 88. The left headphone strap 102 preferably extends from the rear sweatband left edge 34 at the left sweatband gap 89.

A top headphone strap 103 can extend from the canopy top 104 for securing the headphone to the canopy top. The top headphone strap 103 can be hook and loop tape.

Figure 6:
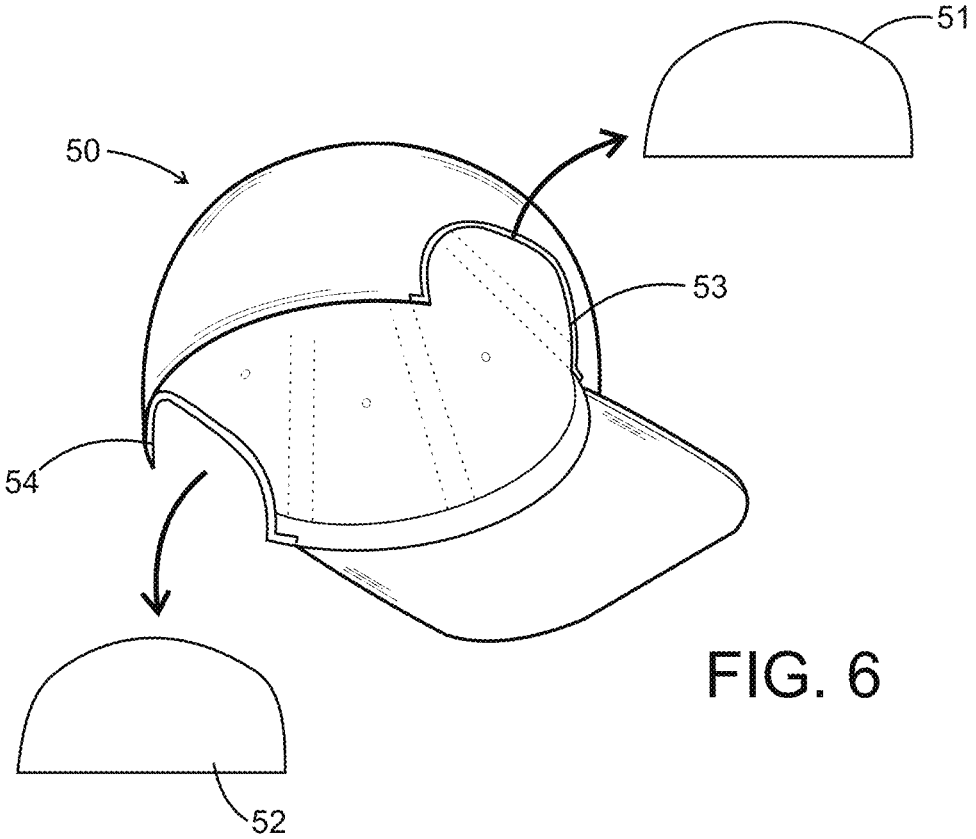
FIG. 6 is a lower right view of the present invention showing the cutout step.

As seen in FIG. 6, a manufacturing step of the hat optionally includes a cut out step 50 when a traditional baseball cap is being modified. In a cut out step 50, a first cut out 51 is a portion of the canopy cut out on a first cut out profile 53 and a second cutout 52 is a portion of the canopy cut out on a second cutout profile 54.

Figure 7:
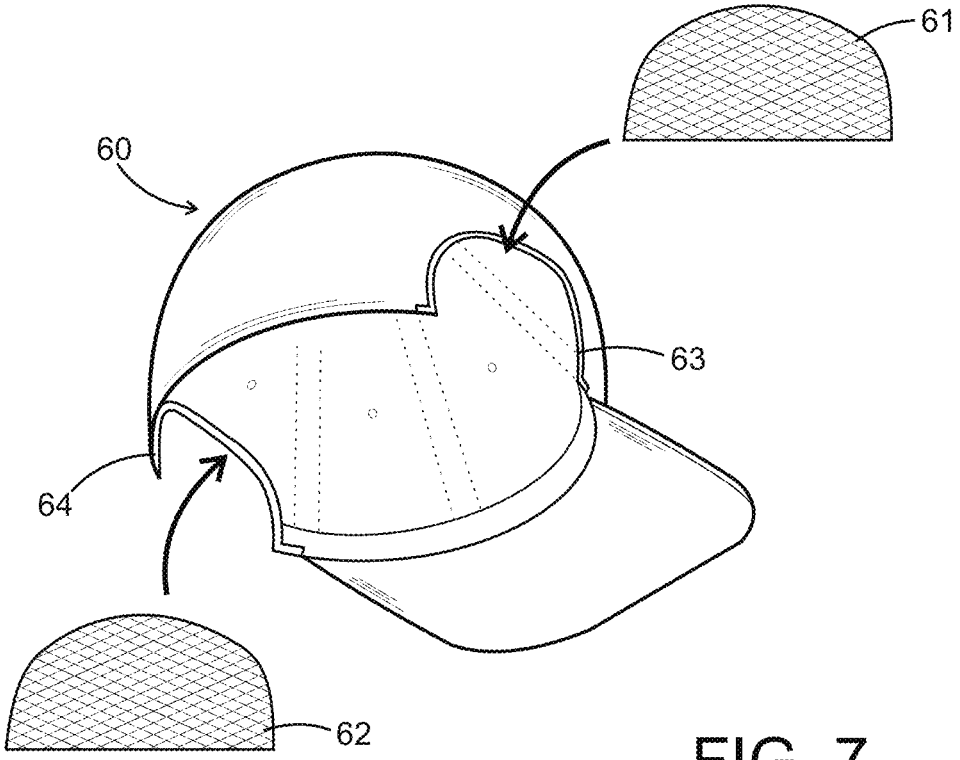
FIG. 7 is a lower right view of the present invention showing the insert step.

As seen in FIG. 7, a manufacturing step of the hat optionally includes an insert step 60. A first insert 61 can be inserted at the first insert profile 63 and a second insert 62 can be inserted at a second insert profile 64. The first insert 61 and the second insert 62 can be omitted if the hat includes a wire support. The right headphone strap 101 and the left headphone strap 102 can be mounted over the first insert 61 and the second insert 62. The headphone straps are preferably elastic and provide additional retaining structure for retaining the headphones to the hat. In this way, the hat serves as an additional retaining structure for the headphones.

Figure 8:
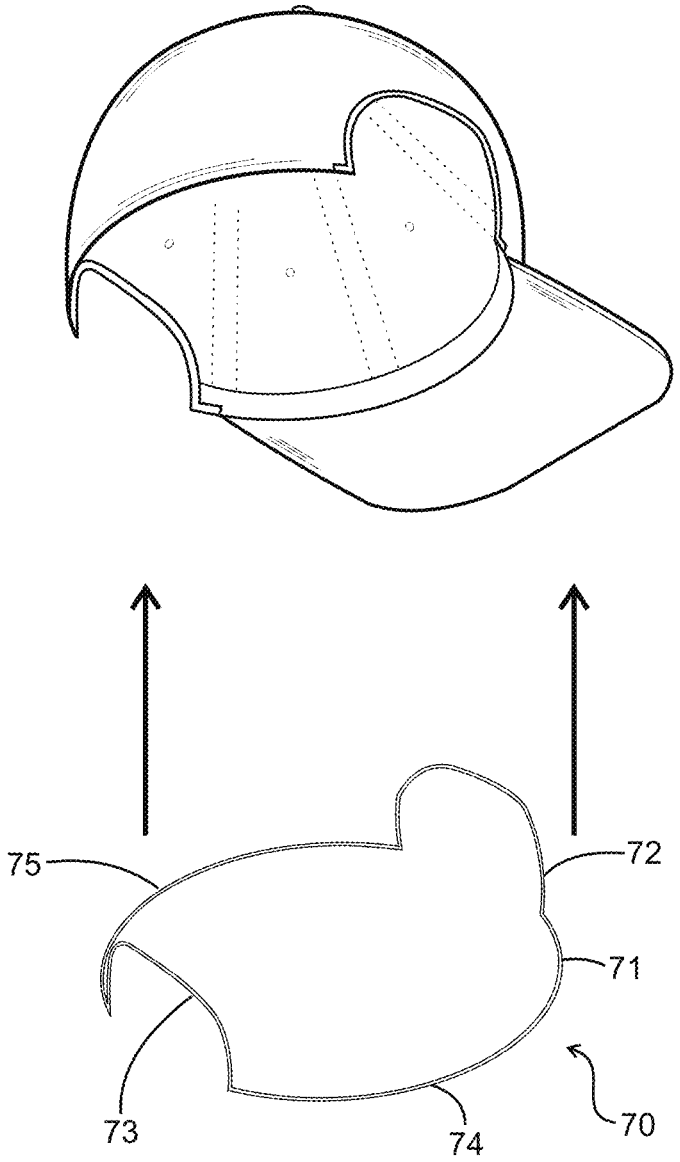
FIG. 8 is a lower right view of the present invention showing a wire insert step.

As seen in FIG. 8, the canopy can receive a wire insert 71 in a wire insert step of manufacturing the hat. The wire insert 71 includes a right ear loop 72 and a left ear loop 73. The rear bend 75 connects the rear portion of the right ear loop to the rear portion of the left ear loop. The front bend 74 connects the front portion of the right ear loop 72 to the front portion of the left ear loop 73. The right ear loop and the left ear loop are formed as springs which allow automatic size adjustment of the cap in a forward to backward direction. The rear bend and the front bend are preferably formed as spring steel members that grip a front and rear sweatband or headband which in turn grip the front and rear portion of a head.

The wire insert 71 is preferably a leaf spring made of a spring steel that biases to the users head. Because the spring steel clips to a user's head, the partially elastic left and right ear panels and panel inserts may be omitted. The bias is preferably in a concave orientation such that the rear bend 75 as a bias towards bending around a user. The front bend 74 also preferably has a bias in a concave orientation such that the bias toward bending around a user can assist to maintain a shape of the visor. The right ear loop 72 and the left ear loop 73 also preferably have a spring bias in a concave orientation that bias the rear bend 75 towards the front bend 74.

Figure 9:
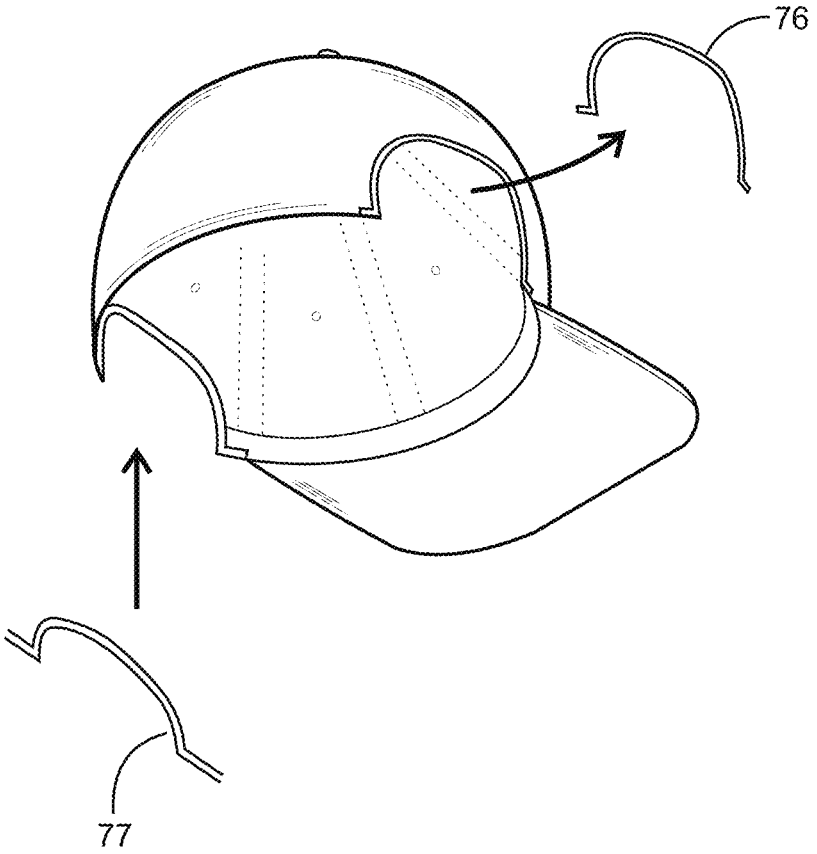
FIG. 9 is a lower right view of the present invention showing a right wire insert and a left wire insert.

As seen in FIG. 9, the wire insert 71 can be formed as a right wire insert 76 and a left wire insert 77. The right wire insert 76 and the left wire insert 77 are also preferably made of a spring steel that acts as a leaf spring for retaining the rear but bad and the front sweatband to a user. The right wire insert and the left wire insert preferably includes a pair of horizontal tip extensions that terminate at wire ends. Again, the right wire insert 76 in the left wire insert 77 preferably bias in a concave orientation such that the users head is clipped between the front of the hat and the rear of hat.

Figure 10:
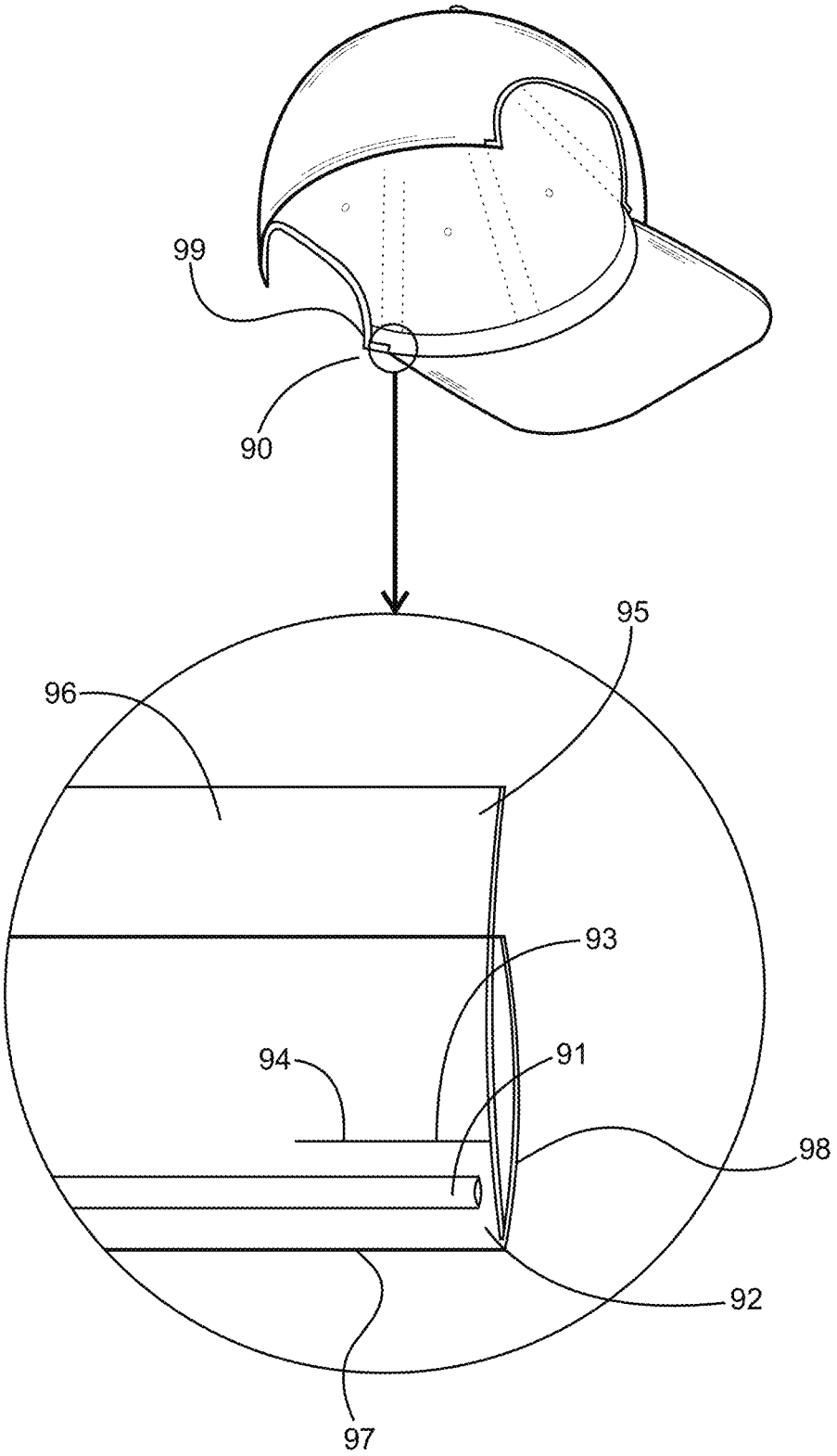
FIG. 10 is a diagram showing a wire end retainer area.

As seen in FIG. 10, the wire ends 91 can fit in wire end receivers 92. The wire end receivers 92 can be formed from a sweatband end 95 between a sweatband outside layer 96 and a sweatband inside layer 98 such as at a sweatband end 95. A wire end retainer 90 is preferably defined in a wire end retainer area 99. The wire end retainer 90 can be implemented as a wire end receiver pocket 93 formed by retaining a wire end 91 between a sweatband outside layer 96 and a sweatband inside layer 98. A horizontal wire and receiver pocket stitch 94 can create a wire end receiver pocket 93. The sweatband outside layer 96 can fold at a sweatband lower fold 97 before continuing upwardly to a sweatband inside layer 98.

The sweatband outside layer 96 can be higher or thicker than the sweatband inside layer 98, although both are preferably approximately the same height. In the case that both are approximately the same height, the figure is exaggerated for clarity. The horizontally oriented wire end 91 can be any one of the four wire ends shown in FIG. 9 that extend horizontally along a lower periphery of the hat near the sweatbands at the sweatband gaps. The sweatband has a thickness that is preferably about 3 mm such as 3.5 mm of woven fabric. The right ear panel and the left ear panel have a thickness of preferably about 0.5 mm of woven fabric such as mesh of 0.15 mm. Accordingly, the difference in thickness between the sweatband and the right and left ear panel can be approximately 2.5 mm. The canopy panels are also preferably made of woven fabric.

The invention claimed is:

1. A hat comprising:

a canopy, wherein the canopy has a front sweatband and a rear sweatband with a right sweatband gap on a right side of the canopy and a left sweatband gap on a left side of the canopy, wherein the front sweatband has a front sweatband right edge and a front sweatband left edge, wherein the rear sweatband has a rear sweatband right edge and a rear sweatband left edge, wherein the front sweatband right edge and the rear sweatband right edge define edges of the right sweatband gap, wherein the front sweatband left edge and the rear sweatband left edge define edges of the left sweatband gap;

a right ear panel mounted to the right side of the canopy at the right sweatband gap, wherein the right ear panel is connected to the front sweatband right edge and the rear sweatband right edge; and a left ear panel mounted to the left side of the canopy at the left sweatband gap, wherein the left ear panel is connected to the front sweatband left edge and the rear sweatband left edge, wherein the left ear loop is made of wire, wherein the right ear loop is made of wire, wherein the left ear loop is mounted to the front sweatband and the rear sweatband at the left sweatband gap, wherein the right ear loop is mounted to the front sweatband and the rear sweatband at the right sweatband gap, wherein the left ear loop has a left ear loop front end and a left ear loop rear end, wherein the right ear loop has a right ear loop front end and a right ear loop rear end, wherein the canopy comprises ear end loop pockets that include a left ear loop front end pocket receiving a left ear loop front end, a left ear loop rear end pocket receiving a left ear loop rear end, a right ear loop front end pocket receiving a right ear loop front end, a right ear loop rear end pocket receiving a right ear loop rear end, wherein the ear loop end pockets are made from stitching an outside layer of each of the front sweatband and the rear sweatband to an inside layer of the each of the front sweatband and the rear sweatband, respectively.

2. A hat comprising:

a canopy, wherein the canopy has a front sweatband and a rear sweatband with a right sweatband gap on a right side of the canopy and a left sweatband gap on a left side of the canopy, wherein the front sweatband has a front sweatband right edge and a front sweatband left edge, wherein the rear sweatband has a rear sweatband right edge and a rear sweatband left edge, wherein the front sweatband right edge and the rear sweatband right edge define edges of the right sweatband gap, wherein the front sweatband left edge and the rear sweatband left edge define edges of the left sweatband gap;

a right ear panel mounted to the right side of the canopy at the right sweatband gap, wherein the right ear panel is connected to the front sweatband right edge and the rear sweatband right edge; and a left ear panel mounted to the left side of the canopy at the left sweatband gap, wherein the left ear panel is connected to the front sweatband left edge and the rear sweatband left edge, wherein the hat further includes a visor, wherein the visor connects to the canopy, wherein the canopy includes a front right canopy panel and a front left canopy panel, wherein the canopy includes a rear right canopy panel and a rear left canopy panel, further including a left ear loop and a right ear loop, wherein the left ear loop is made of wire, wherein the right ear loop is made of wire, wherein the left ear loop is mounted to the front sweatband and the rear sweatband at the left sweatband gap, wherein the right ear loop is mounted to the front sweatband and the rear sweatband at the right sweatband gap, wherein the left ear loop has a left ear loop front end and a left ear loop rear end, wherein the right ear loop has a right ear loop front end and a right ear loop rear end, wherein the canopy comprises ear end loop pockets that include a left ear loop front end pocket receiving a left ear loop front end, a left ear loop rear end pocket receiving a left ear loop rear end, a right ear loop front end pocket receiving a right ear loop front end, a right ear loop rear end pocket receiving a right ear loop rear end, wherein the ear loop end pockets are made from stitching a sweatband outside layer of each of the front sweatband and the rear sweatband to a sweatband inside layer of each of the front sweatband and the rear sweatband, respectively.

* * * * *